US011549236B1

(12) United States Patent
Wu et al.

(10) Patent No.: US 11,549,236 B1
(45) Date of Patent: Jan. 10, 2023

(54) WORK VEHICLE WITH IMPROVED BI-DIRECTIONAL SELF-LEVELING FUNCTIONALITY AND RELATED SYSTEMS AND METHODS

(71) Applicant: CNH Industrial America LLC, New Holland, PA (US)

(72) Inventors: Duqiang Wu, Boilingbrook, IL (US); Aditya Singh, Boilingbrook, IL (US); Navneet Gulati, Naperville, IL (US)

(73) Assignee: CNH Industrial America LLC, New Holland, PA (US)

( * ) Notice: Subject to any disclaimer, the term of this patent is extended or adjusted under 35 U.S.C. 154(b) by 23 days.

(21) Appl. No.: 17/349,290

(22) Filed: Jun. 16, 2021

(51) Int. Cl.

| | |
|---|---|
| ***E02F 9/20*** | (2006.01) |
| ***E02F 9/22*** | (2006.01) |
| ***F15B 15/20*** | (2006.01) |
| *E02F 3/43* | (2006.01) |

(52) U.S. Cl.
CPC ..... *E02F 9/2041* (2013.01); *E02F 9/2203* (2013.01); *E02F 9/2228* (2013.01); *F15B 15/20* (2013.01); *E02F 3/433* (2013.01); *E02F 9/2267* (2013.01); *E02F 9/2271* (2013.01)

(58) Field of Classification Search
CPC ..... E02F 9/2041; E02F 9/2228; E02F 3/433
See application file for complete search history.

(56) References Cited

U.S. PATENT DOCUMENTS

| | | | | |
|---|---|---|---|---|
| 4,844,685 | A * | 7/1989 | Sagaser | E02F 3/433 91/363 R |
| 5,052,883 | A * | 10/1991 | Morita | E02F 3/433 60/426 |
| 7,874,151 | B2 | 1/2011 | Lin et al. | |
| 7,881,845 | B2 | 2/2011 | Nichols | |
| 8,155,844 | B2 | 4/2012 | Peters | |
| 8,340,875 | B1 | 12/2012 | Shatters et al. | |
| 8,463,508 | B2 * | 6/2013 | Nicholson | E02F 3/28 172/3 |
| 8,843,282 | B2 | 9/2014 | Atkinson | |
| 8,845,265 | B2 | 9/2014 | Oyama et al. | |

(Continued)

FOREIGN PATENT DOCUMENTS

| | | |
|---|---|---|
| WO | WO 2001/069089 | 9/2001 |

OTHER PUBLICATIONS

Latorre-Biel et al., "Front End Loader with Automatic Levelling for Farm Tractors", Research Paper, Department of Mechanical, Energy, and Materials Engineering, Public University of Navarre, Campus of Tudela, Spain. Published Jun. 11, 2016. (16 pages).

*Primary Examiner* — Thomas E Lazo
(74) *Attorney, Agent, or Firm* — Rickard Demille; Rebecca Henkel

(57) ABSTRACT

A method for automatically adjusting the position of an implement of a lift assembly of a work vehicle includes determining a tilt transition boom angle for the lift assembly, determining a closed-loop control signal associated with controlling movement of the implement based at least in part on the tilt transition boom angle, generating a valve command signal based at least in part on the closed-loop control signal, and controlling an operation of at least one valve associated with the implement based at least in part on the valve command signal to maintain the implement at a target implement angle as a boom of the lift assembly is being moved across a boom travel range.

20 Claims, 7 Drawing Sheets

(56) References Cited

U.S. PATENT DOCUMENTS

| | | | | |
|---|---|---|---|---|
| 8,886,415 | B2 | 11/2014 | Shatters et al. | |
| 8,974,171 | B2 * | 3/2015 | Shirao | E02F 3/432 701/50 |
| 9,238,899 | B2 | 1/2016 | Matsumoto et al. | |
| 9,464,410 | B2 | 10/2016 | Johnson et al. | |
| 9,567,724 | B2 | 2/2017 | Wagner | |
| 9,580,883 | B2 | 2/2017 | Singh et al. | |
| 9,796,571 | B2 * | 10/2017 | Singh | E02F 9/2041 |
| 9,822,507 | B2 * | 11/2017 | Singh | E02F 9/2029 |
| 9,956,966 | B2 | 5/2018 | Versteyhe et al. | |
| 10,017,912 | B2 * | 7/2018 | Singh | E02F 9/265 |
| 10,030,354 | B1 * | 7/2018 | Dean | E02F 9/2041 |
| 10,125,798 | B2 | 11/2018 | Vigholm et al. | |
| 10,981,763 | B2 * | 4/2021 | Myers | B66F 9/065 |

* cited by examiner

WORK VEHICLE WITH IMPROVED BI-DIRECTIONAL SELF-LEVELING FUNCTIONALITY AND RELATED SYSTEMS AND METHODS

FIELD OF THE INVENTION

The present subject matter relates generally to work vehicles and, more particularly, to systems and methods for automatically adjusting the orientation or angular position of an implement of a work vehicle using closed-loop control so as to provide bi-directional self-leveling functionality as the vehicle's boom or loader arms are being moved.

BACKGROUND OF THE INVENTION

Work vehicles having lift assemblies, such as skid steer loaders, telescopic handlers, wheel loaders, backhoe loaders, forklifts, compact track loaders and the like, are a mainstay of construction work and industry. For example, skid steer loaders typically include a lift assembly having a pair of loader arms pivotally coupled to the vehicle's chassis that can be raised and lowered at the operator's command. In addition, the lift assembly includes an implement attached to the ends of the loader arms, thereby allowing the implement to be moved relative to the ground as the loader arms are raised and lowered. For example, a bucket is often coupled to the loader arms, which allows the skid steer loader to be used to carry supplies or particulate matter, such as gravel, sand, or dirt, around a worksite.

When using a work vehicle to perform a material moving operation or any other suitable operation, it is often desirable to maintain the vehicle's bucket or other implement at a constant angular position relative to the vehicle's driving surface (or relative to any other suitable reference point or location) as the loader arms are being raised and/or lowered. To achieve such control, conventional work vehicles typically rely on the operator manually adjusting the position of the implement as the loader arms are being moved. Unfortunately, this task is often quite challenging for the operator and can lead to materials being inadvertently dumped from the implement. To solve this problem, control systems have been disclosed that attempt to provide a control algorithm for automatically maintaining a constant angular implement position as the vehicle's loader arms are being moved. However, such previously disclosed automatic control systems still suffer from many drawbacks, including poor system responsiveness and imprecise implement position control. In particular, previously disclosed control systems have been unable to properly accommodate the non-linearity of the operational dynamics of the lift assembly as the loader arms are being moved, thereby providing less than desirable results. This particularly true for work vehicles that include a Z-bar linkage between the tilt cylinder and the implement for adjusting the position of the implement.

Accordingly, an improved system and method for automatically adjusting the position of an implement of a work vehicle so as to maintain the implement at a desired angular orientation relative to a given reference point would be welcomed in the technology.

SUMMARY OF THE INVENTION

Aspects and advantages of the technology will be set forth in part in the following description, or may be obvious from the description, or may be learned through practice of the technology.

In one aspect, the present subject matter is directed to a method for automatically adjusting the position of an implement of a lift assembly of a work vehicle, the lift assembly comprising a boom coupled to the implement. The method includes determining, with the computing system, a tilt transition boom angle for the lift assembly that corresponds to a position within a boom travel range of the boom at which a direction of movement of the implement must be reversed to maintain the implement at a target implement angle as the boom is being moved across such position. The method also includes determining, with the computing system, a closed-loop control signal associated with controlling movement of the implement based at least in part on the tilt transition boom angle, generating, with the computing system, a valve command signal based at least in part on the closed-loop control signal, and controlling, with computing system, an operation of at least one valve associated with the implement based at least in part on the valve command signal to maintain the implement at the target implement angle as the boom is being moved across the boom travel range.

In another aspect, the present subject matter is directed to a system for controlling the operation of a work vehicle. The system includes a lift assembly including a boom and an implement coupled to the boom. The system also includes at least one tilt valve in fluid communication with a corresponding tilt cylinder, with the tilt valve(s) being configured to control a supply of hydraulic fluid to the tilt cylinder to adjust a position of the implement relative to the boom. Additionally, the system includes a computing system communicatively coupled to the tilt valve(s). The computing system is configured to receive an input indicative of a target implement angle at which the implement is to be maintained as the boom is being moved across a boom travel range of the boom and determine a tilt transition boom angle for the lift assembly based at least in part on the target implement angle. The tilt transition boom angle corresponds to a position within the boom travel range at which the tilt cylinder must transition between being stroked and destroked in order to maintain the implement at the target implement angle as the boom is being moved across such position. The computing system is also configured to determine a closed-loop control signal associated with controlling movement of the implement based at least in part on the tilt transition boom angle, generate a valve command signal based at least in part on the closed-loop control signal, and control an operation of the tilt valve(s) based at least in part on the valve command signal to maintain the implement at the target implement angle as the boom is being moved across the boom travel range.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended figures, in which.

Figure 1:
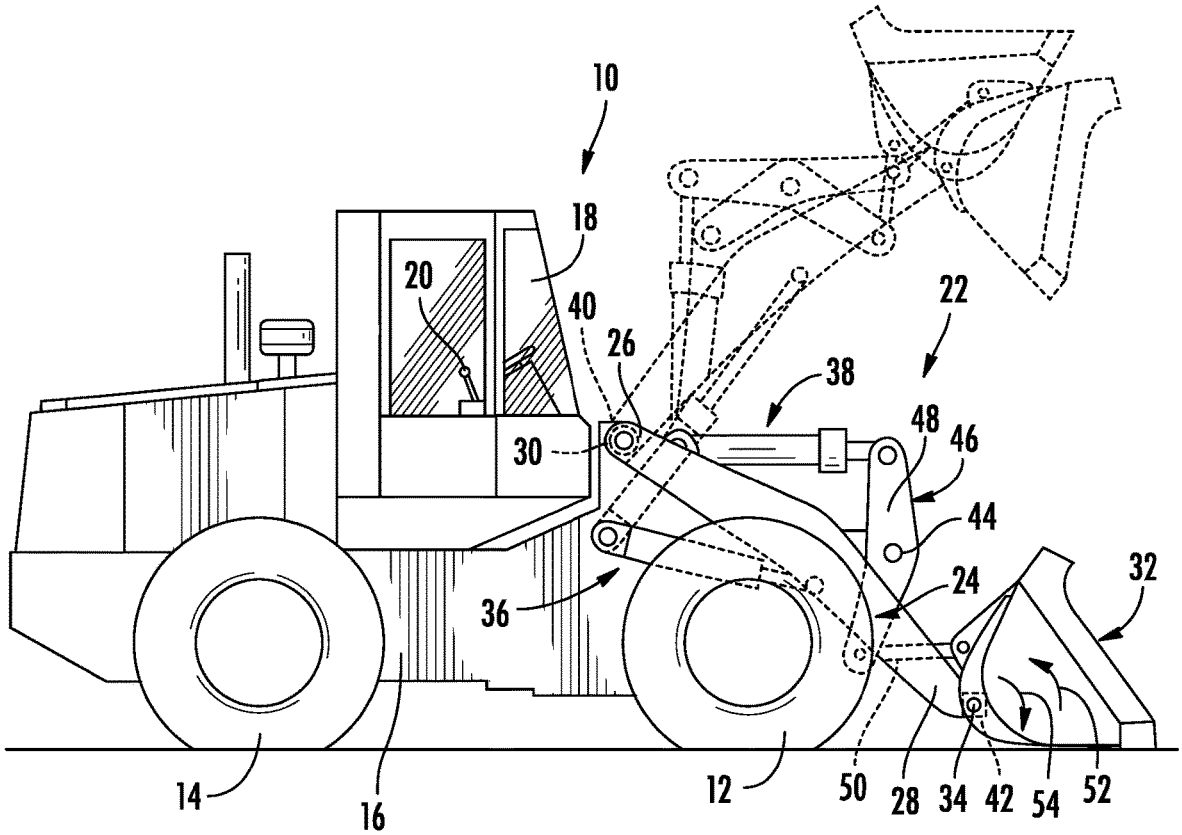
FIG. 1 illustrates a side view of one embodiment of a work vehicle in accordance with aspects of the present subject matter.

Repeat use of reference characters in the present specification and drawings is intended to represent the same or analogous features or elements of the present technology.

DETAILED DESCRIPTION OF THE DRAWINGS

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to systems and methods for automatically adjusting the position of an implement of a lift assembly of a work vehicle in order to maintain the implement at a fixed or constant angular orientation relative to a given reference point as the boom of the lift assembly is being raised or lowered. In several embodiments, such control of the position of the implement may be achieved using a closed-loop control algorithm employing feed-forward control. In accordance with aspects of the present subject matter, the feed-forward control of the closed-loop control algorithm may be configured to generate an output signal for adjusting the position of the implement based at least in part on an input signal associated with a tilt transition boom an of the lift assembly. As will be described below, the tilt transition boom angle may correspond to a position within the boom's travel range at which a direction of movement of the implement must be reversed in order to maintain the implement at a target implement angle as the boom is being moved across such position. For instance, when the movement of the implement is being adjusted via one or more tilt cylinders, the tilt transition boom angle may correspond to the position within the boom travel range at which the tilt cylinder(s) must transition between being stroked and de-stroked in order to maintain the implement at the target implement angle. Such tilt-transition-based input signal(s) may allow for the feed-forward control to reduce system delays, thereby increasing the system's overall responsiveness.

Additionally, in several embodiments, the disclosed systems and methods may also be configured to apply one or more additional control functions to further improve overall responsiveness and/or performance when automatically controlling the operation of the vehicle's lift assembly. For instance, in one embodiment, a valve standby control mode may be executed to reduce the amount of jerky motion or vibrations as the associated hydraulic valves are being transitioned between their opened and closed states, as well as to increase the system responsiveness when transitioning the valves from the closed state to the opened state. Additionally, in one embodiment, one or more valve lock-up control functions may be applied to minimize the frequency at which the valves are switched back and forth between the opened and closed states in certain instances. Moreover, as will be described below, a boom cushion control mode may be executed to allow lift valve control commands to be ramped down according to a variable rate in a manner that minimizes the likelihood that the boom experiences a hard impact against its upper limit stop as the boom is being moved towards the top end of its travel range.

Referring now to the drawings, FIG. 1 illustrates a side view of one embodiment of a work vehicle 10. As shown, the work vehicle 10 is configured as a wheel loader. However, in other embodiments, the work vehicle 10 may be configured as any other suitable work vehicle known in the art, such as any other work vehicle including a movable boom (e.g., any other type of front loader, such as skid steer loaders, backhoe loaders, compact track loaders, and/or the like).

As shown in FIG. 1, the work vehicle 10 includes a pair of front wheels 12, a pair or rear wheels 14, and a frame or chassis 16 coupled to and supported by the wheels 12, 14. An operator's cab 18 may be supported by a portion of the chassis 16 and may house various control or input devices (e.g., levers, pedals, control panels, buttons and/or the like) for permitting an operator to control the operation of the work vehicle 10. For instance, as shown in FIG. 1, the work vehicle 10 includes one or more control levers 20 for controlling the operation of one or more components of a lift assembly 22 of the work vehicle 10.

As shown in FIG. 1, the lift assembly 22 includes a pair of loader arms 24 (one of which is shown) extending lengthwise between a first end 26 and a second end 28. The loader arms 24 will generally be referenced herein as the boom 24 of the lift assembly 22. In this respect, the first end 26 of the boom 24 may be pivotably coupled to the chassis 16 at pivot joints 30. Similarly, the second end 28 of the boom 24 may be pivotably coupled to a suitable implement 32 of the work vehicle 10 (e.g., a bucket, fork, blade, and/or the like) at pivot joints 34. In addition, the lift assembly 22 also includes a plurality of fluid-driven actuators for controlling the movement of the boom 24 and the implement 32. For instance, the lift assembly 22 may include a pair of hydraulic lift cylinders 36 (one of which is shown) coupled between the chassis 16 and the boom 24 for raising and lowering the boom 24 relative to the ground. Moreover, the lift assembly 22 may include a pair of hydraulic tilt cylinders 38 (one of which is shown) for tilting or pivoting the implement 32 relative to the boom 24.

Furthermore, in several embodiments, the work vehicle 10 may include a boom position sensor 40. In general, the boom position sensor 40 may be configured to capture data indicative of the angle or orientation of the boom 24 relative to the chassis 16. For example, the boom position sensor 40 may correspond to a potentiometer positioned between the boom 24 and the chassis 16, such as within one of the pivot joints 30. In this respect, as the boom 24 and the implement 32 are raised and lowered relative to the ground, the voltage output by the lift position sensor 40 may vary, with such voltage being indicative of the angle of the boom 24 relative to the chassis 16. However, in other embodiments, the boom position sensor 40 may correspond to any other suitable sensor(s) and/or sensing device(s) configured to capture data associated with the angle or orientation of the boom 24 relative to the chassis 16 and/or relative to the ground.

Moreover, in some embodiments, the work vehicle 10 may include an implement position sensor 42. In general, the implement position sensor 42 may be configured to capture data indicative of the angle or orientation of the implement 32 relative to the boom 24. For example, in such an embodiment, the implement position sensor 42 may correspond to a potentiometer positioned between the implement 32 and the second ends 28 of the boom 24 and the chassis 16, such as within one of the pivot joints 34. In this respect, as the implement 32 is pivoted relative to the boom 24, the voltage output by the implement position sensor 42 may vary, with such voltage being indicative of the angle orientation of the implement 32 relative to the boom 24. However, in other embodiments, the implement position sensor 42 may correspond to any other suitable sensor(s) and/or sensing device(s) configured to capture data associated with the angle or orientation of the implement 32 relative to the boom 24, the chassis 16, and/or the ground. For example, in some embodiments, the implement position sensor 42 may be positioned at or within a pivot joint 44 about which portions of a bell crank assembly 46 of the work vehicle 10 rotates.

As particularly shown in FIG. 1, the bell crank assembly 46 includes a lever arm 48 and an implement linkage 50 coupled between the tilt cylinders 38 and the implement 32. Specifically, the lever arm 48 is pivotably coupled at one end to the tilt cylinders 38 and at the opposed end to the linkage 50, with the lever arm 48 being rotatable about pivot joint 44. Similarly, as shown in FIG. 1, one end of the linkage 50 is pivotably coupled to the lever arm 48 and the opposed end of the linkage 50 is pivotably coupled to the implement 32. As such, by extending the tilt cylinders 38, the lever 48 of the bell crank assembly 46 may rotate in a clockwise direction (e.g., relative to the view shown in FIG. 1) about the pivot point 44, thereby pulling the linkage 50 backward and resulting in the implement 32 being tilted upwardly in a rollback direction (as indicated by arrow 52 in FIG. 1). Similarly, by retracting the tilt cylinders 38, the lever 48 of the bell crank assembly 46 may rotate in a counter-clockwise direction (e.g., relative to the view shown in FIG. 1) about the pivot point 44, thereby pushing the linkage 50 forward and resulting in the implement 32 being tilted downwardly in a dump direction (as indicated by arrow 54 in FIG. 1). It should be appreciated that the tilt cylinders 38 and the bell crank assembly 46 generally form a Z-bar linkage between the chassis 16 and the implement 32.

It should also be appreciated that the configuration of the work vehicle 10 described above and shown in FIG. 1 is provided only to place the present subject matter in an exemplary field of use. Thus, it should be appreciated that the present subject matter may be readily adaptable to any manner of work vehicle configuration. For example, the work vehicle 10 was described above as including a pair of lift cylinders 36 and a pair of tilt cylinders 38. However, in other embodiments, the work vehicle 10 may, instead, include any number of lift cylinders 36 and/or tilt cylinders 38, such as by only including a single lift cylinder 36 for controlling the movement of the boom 24 and/or a single tilt cylinder 38 for controlling the movement of the implement 32.

Figure 2:
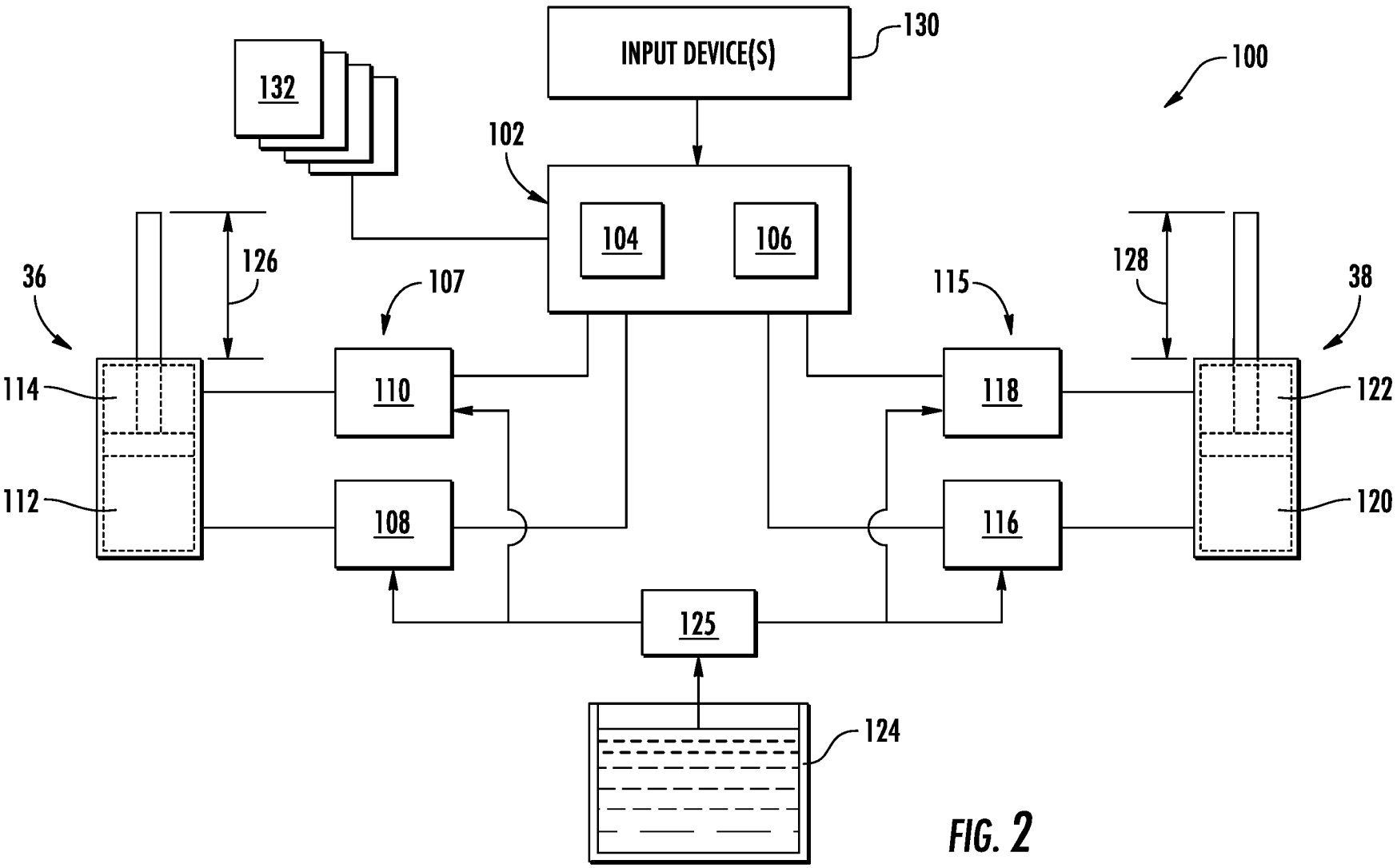
FIG. 2 illustrates a schematic view of one embodiment of a suitable control system for controlling the operation of various components of a work vehicle in accordance with aspects of the present subject matter, particularly illustrating the control system configured for controlling various hydraulic components of the work vehicle, such as the hydraulic cylinders of the work vehicle.

Referring now to FIG. 2, one embodiment of a control system 100 suitable for automatically controlling the operation of the various lift assembly components of a work vehicle is illustrated in accordance with aspects of the present subject matter. In general, the control system 100 will be described herein with reference to the work vehicle 10 described above with reference to FIG. 1. However, it should be appreciated by those of ordinary skill in the art that the disclosed system 100 may generally be utilized to the control the lift assembly components of any suitable work vehicle.

As shown, the control system 100 may generally include a computing system 102 configured to electronically control the operation of one or more components of the work vehicle 10, such as the various hydraulic components of the work vehicle 10 (e.g., the lift cylinders 36, the tilt cylinders 38 and/or the associated valve(s)). In general, the computing system 102 may comprise any suitable processor-based device known in the art, such as a computing device or any suitable combination of computing devices. Thus, in several embodiments, the computing system 102 may include one or more processor(s) 104 and associated memory device(s) 106 configured to perform a variety of computer-implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) 106 of the computing system 102 may generally comprise memory element(s) including, but are not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) 106 may generally be configured to store suitable computer-readable instructions that, when implemented by the processor(s) 104, configure the computing system 102 to perform various computer-implemented functions, such as the closed-loop control algorithm 200 described below with reference to FIG. 4. In addition, the computing system 102 may also include various other suitable components, such as a communications circuit or module, one or more input/output channels, a data/control bus and/or the like.

It should be appreciated that the computing system 102 may correspond to an existing controller of the work vehicle 10 or the computing system 102 may correspond to a separate processing device. For instance, in one embodiment, the computing system 102 may form all or part of a separate plug-in module that may be installed within the work vehicle 10 to allow for the disclosed system and method to be implemented without requiring additional software to be uploaded onto existing control devices of the vehicle 10.

In several embodiments, the computing system 102 may be configured to be coupled to suitable components for controlling the operation of the various cylinders 36, 38 of the work vehicle 10. For example, the computing system 102 may be communicatively coupled to a suitable lift valve assembly 107 including valves 108, 110 (e.g., solenoid-activated valves) configured to control the supply of hydraulic fluid to each lift cylinder 36 (only one of which is shown in FIG. 2). Specifically, as shown in the illustrated embodiment, the lift valve assembly 107 may include a first lift valve 108 for regulating the supply of hydraulic fluid to a cap end 112 of each lift cylinder 36. In addition, the lift valve assembly 107 may include a second lift valve 110 for regulating the supply of hydraulic fluid to a rod end 114 of each lift cylinder 36. Moreover, the computing system 102 may be communicatively coupled to a suitable tilt valve assembly 115 including valves 116, 118 (e.g., solenoid-activated valves) configured to regulate the supply of hydraulic fluid to each tilt cylinder 38 (only one of which is shown in FIG. 2). For example, as shown in the illustrated embodiment, the tilt valve assembly 115 may include a first tilt valve 116 for regulating the supply of hydraulic fluid to a cap end 120 of each tilt cylinder 38 and a second tilt valve 118 for regulating the supply of hydraulic fluid to a rod end 122 of each tilt cylinder 38. It should be appreciated that, in one embodiment, the lift valve assembly 107 and the tilt valve assembly 115 may form part of a valve block (not shown) of the work vehicle 10.

During operation, the computing system 102 may be configured to control the operation of each valve 108, 110, 116, 118 in order to control the flow of hydraulic fluid supplied to each of the cylinders 36, 38 from a suitable hydraulic tank 124 of the work vehicle 10 via an associated pump 125. For instance, the computing system 102 may be configured to transmit suitable control commands to the lift valves 108, 110 in order to regulate the flow of hydraulic fluid supplied to the cap and rod ends 112, 114 of each lift cylinder 36, thereby allowing for control of a stroke length 126 of the piston rod associated with each cylinder 36. Similarly, the computing system 102 may be configured to transmit suitable control commands to the tilt valves 116, 118 in order to regulate the flow of hydraulic fluid supplied to the cap and rod ends 120, 122 of each tilt cylinder 38, thereby allowing for control of a stroke length 128 of the piston rod associated with each cylinder 38. Thus, by carefully controlling the actuation or stroke length 126, 128 of the lift and tilt cylinders 36, 38, the computing system 102 may, in turn, be configured to automatically control the manner in which the boom 24 and the implement 32 are positioned or oriented relative to the vehicle's driving surface and/or relative to any other suitable reference point. For instance, the computing system 102 may be configured to cause the implement 32 to be tilted in the rollback direction 52 (FIG. 1) by controlling the operation of the tilt valve assembly 115 such that hydraulic fluid is supplied to the cap end 120 of the tilt cylinders 38, thereby causing the cylinders 38 to extend or increase their stoke length 128. Similarly, the computing system 102 may be configured to cause the implement 32 to be tilted in the dump direction 54 (FIG. 1) by controlling the operation of the tilt valve assembly 115 such that hydraulic fluid is supplied to the rod end 122 of the tilt cylinders 38, thereby causing the cylinders 38 to retract or de-stroke which decreases their stoke length 128.

It should be appreciated that the current commands provided by the computing system 102 to the various valves 108, 110, 116, 118 may be in response to inputs provided by the operator via one or more input devices 130. For example, one or more input devices 130 (e.g., the control lever(s) 20 shown in FIG. 1) may be provided within the cab 18 to allow the operator to provide operator inputs associated with controlling the position of the boom 24 and the implement 32 relative to the vehicle's driving surface (e.g., by varying the current commands supplied to the lift and/or tilt valves 108, 110, 116, 118 based on operator-initiated changes in the position of the control lever(s) 20). Alternatively, the current commands provided to the various valves 108, 110, 116, 118 may be generated automatically based on a suitable control algorithm being implemented by the computing system 102. For instance, as will be described in detail below, the computing system 102 may be configured to implement a closed-loop control algorithm for automatically controlling the angular orientation of the implement 32. In such instance, output signals or valve control commands generated by the computing system 102 when implementing the closed-loop control algorithm may be automatically transmitted to the tilt valve(s) 116, 118 to provide for precision control of the angular orientation/position of the implement 32.

Additionally, it should be appreciated that the work vehicle 10 may also include any other suitable input devices 130 for providing operator inputs to the computing system 102. For instance, in accordance with aspects of the present subject matter, the operator may be allowed to select/input an angular orientation for the implement 32 (e.g., a target implement angle) that is to be maintained as the boom 24 is being moved. In such instance, the desired orientation may be selected or input by the operator using any suitable means that allows for the communication of such orientation to the computing system 102. For example, the operator may be provided with a suitable input device(s) 130 (e.g., a button(s), touch screen, lever(s), etc.) that allows the operator to select/input a particular angle at which the implement 32 is to be maintained during movement of the boom 24, such as a specified target implement angle defined relative to the vehicle's driving surface. In addition, or as an alternative thereto, the operator may be provided with a suitable input device(s) 130 (e.g., a button(s), touch screen, lever(s), etc.) that allows the operator to record or select the current angular orientation of the implement 32 as the desired or target implement agnel, which may then be stored within the memory 106 of the computing system 102. Moreover, in one embodiment, one or more pre-defined implement orientation/position/angle settings may be stored within the memory 106 of the computing system 102. In such an embodiment, the operator may simply select one of the pre-defined orientation/position/angle settings in order to instruct the computing system 102 as to the target angle for the implement 32.

Moreover, as shown in FIG. 2, the computing system 102 may also be communicatively coupled to one or more position sensors 132 for monitoring the position(s) and/or orientation(s) of the boom 24 and/or the implement 32 (including, for example, the position sensors 40, 42 described above with reference to FIG. 1). In several embodiments, the position sensor(s) 132 may correspond to one or more angle sensors (e.g., a rotary or shaft encoder(s)

or any other suitable angle transducer) configured to monitor the angle or orientation of the boom 24 and/or implement 32 relative to one or more reference points. For instance, in one embodiment, an angle sensor(s) may be positioned at pivot point 34 (FIG. 1) to allow the angle of the implement 32 relative to the boom 24 to be monitored. Similarly, an angle sensor(s) may be positioned at pivot point 30 to allow the angle of the boom 24 relative to a given reference point on the work vehicle 10 to be monitored. In addition to such angle sensor(s), or as an alternative thereto, one or more secondary angle sensors (e.g., a gyroscope, inertial sensor, etc.) may be mounted to the boom 24 and/or the implement 32 to allow the orientation of such component(s) relative to the vehicle's driving surface to be monitored.

In other embodiments, the position sensor(s) 132 may correspond to any other suitable sensor(s) that is configured to provide a measurement signal associated with the position and/or orientation of the boom 24 and/or the implement 32. For instance, the position sensor(s) 132 may correspond to one or more linear position sensors and/or encoders associated with and/or coupled to the piston rod(s) or other movable components of the cylinders 36, 38 in order to monitor the travel distance of such components, thereby allowing for the position of the boom 24 and/or the implement 32 to be calculated. Alternatively, the position sensor(s) 132 may correspond to one or more non-contact sensors, such as one or more proximity sensors, configured to monitor the change in position of such movable components of the cylinders 36, 38. In another embodiment, the position sensor(s) 132 may correspond to one or more flow sensors configured to monitor the fluid into and/or out of each cylinder 36, 38, thereby providing an indication of the degree of actuation of such cylinders 36, 38 and, thus, the location of the corresponding boom 24 and/or implement 32. In a further embodiment, the position sensor(s) 132 may correspond to a transmitter(s) configured to be coupled to a portion of one or both of the boom 24 and/or the implement 32 that transmits a signal indicative of the height/position and/or orientation of the boom/implement 24, 32 to a receiver disposed at another location on the vehicle 10.

It should be appreciated that, although the various sensor types were described above individually, the work vehicle 10 may be equipped with any combination of position sensors 132 and/or any associated sensors that allow for the position and/or orientation of the boom 24 and/or the implement 32 to be monitored. For instance, in one embodiment, the work vehicle 10 may include both a first set of position sensors 132 (e.g., angle sensors) associated with the pins located at the pivot joints defined at the pivot points 30, 34 for monitoring the relative angular positions of the boom 24 and the implement 32 and a second set of position sensors 132 (e.g., a linear position sensor(s), flow sensor(s), etc.) associated with the lift and tilt cylinders 36, 38 for monitoring the actuation of such cylinders 36, 38.

Additionally, it should be appreciated that the computing system 102 may also be coupled to various other sensors for monitoring one or more other operating parameters of the work vehicle 10. For instance, the computing system 102 may also be coupled to one or more pressure sensors configured to monitor the fluid pressure of the hydraulic fluid at one or more locations within the system 100 and/or one or more temperature sensors configured to monitor the temperature of the hydraulic fluid supplied between the tank 124 and the various cylinders 36, 38. In addition, the computing system 102 may be coupled to one or more velocity sensors and/or accelerometers (not shown) for monitoring the velocity and/or acceleration of the boom 24 and/or the implement 32.

It should also be appreciated that, as used herein, the term "monitor" and variations thereof indicates that the various sensors of the system 100 may be configured to provide a direct or indirect measurement of the operating parameters being monitored. Thus, the sensors may, for example, be used to generate signals relating to the operating parameter being monitored, which can then be utilized by the computing system 102 to determine or predict the actual operating parameter.

In addition, it should be appreciated that, as described herein, the computing system 102 may be configured to receive a signal indicative of a given operating parameter or state of the work vehicle 10 from an external source (e.g., from a sensor coupled to the computing system 102) or from an internal source. For example, signals transmitted to, within and/or from the processor(s) 104 and/or memory 106 of the computing system 102 may be considered to have been "received" by the computing system 102. Thus, in embodiments in which the computing system 102 is utilizing a constant value for a given operating parameter of the work vehicle (e.g., the hydraulic pressure and/or the fluid temperature), a signal indicative of such operating parameter may be received by the computing system 102 when the constant value is, for example, retrieved from memory by the processor(s) 104 and/or utilized by the processor(s) 104 as an input within a given processing step (e.g., when implementing the closed-loop control algorithm described below).

Figure 3:
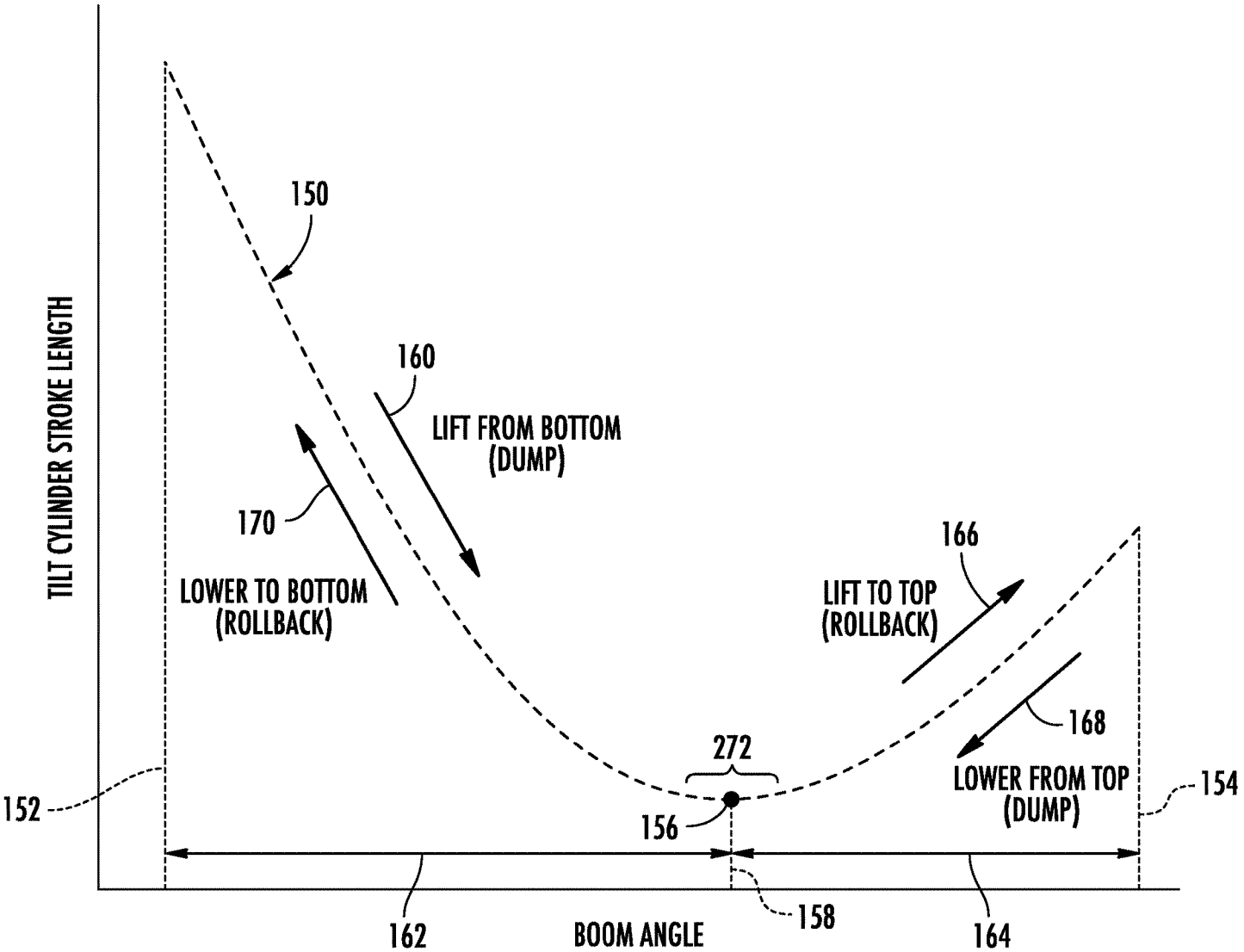
FIG. 3 illustrates a graphical view of an example dataset providing a tilt cylinder control curve for maintaining an implement of a work vehicle at a given target implement angle as the vehicle's boom is moved between a bottom end of its travel range and a top end of its travel range in accordance with aspects of the present subject matter.

Referring now to FIG. 3, a graphical view of an example dataset providing a tilt cylinder control curve 150 for maintaining an implement (e.g., implement 32 of FIG. 1) at a given target implement angle as a boom (e.g., boom 24 of FIG. 1) is moved between a bottom end of its travel range (indicated by vertical line 152) and a top end of its travel range (indicated by vertical line 154). Specifically, the dataset charts the boom position (e.g., in terms of a boom angle) relative to the stroke length of the tilt cylinders 38. As shown in FIG. 3, a non-linear relationship exists between the tilt cylinder stroke length and the boom angle. Specifically, due to the configuration used within the lift assembly 22 for tiling the implement 32 (e.g., the Z-bar linkage), the tilt cylinders 38 must transition between being de-stroked and stroked as the boom 24 is being lifted or lowered across its travel range. As shown in FIG. 3, the transition between stroking/de-stroking of the tilt-cylinders 38 occurs at the vertex 156 of the curve 150, which is defined at a specific boom position (indicated by line 158) across the travel range of the boom 24 (hereinafter referred to as the tilt transition boom angle 158).

As shown in FIG. 3, when initially raising the boom 24 from the bottom end 152 of the travel range, the tilt cylinders 38 must be initially de-stroked (indicated by arrow 160) across a first range of boom angles 162 (e.g., defined between the bottom end 152 of the travel range and the tilt transition boom angle 158) to pivot the implement 32 in the dumping direction 54 (FIG. 1) in order to maintain the implement 32 at the target implement angle. However, as the boom 24 is lifted past the tilt transition boom angle 158 and continues to be raised towards the top end 154 of the travel range across a second range of boom angles 164 (e.g., defined between the tilt transition boom angle 158 and the top end 154 of the travel range), the control of the tilt cylinders 38 must be reversed to maintain the implement 32 at the target implement angle. Specifically, as shown in FIG.

3, as the boom 24 transitions into the second range of boom angles 164 at the tilt transition boom angle 158 and is lifted through such angular range 164 towards the top end 154 of the travel range, the tilt cylinders 38 must be stroked (indicated by arrow 166) to pivot the implement 32 in the rollback direction 52 (FIG. 1) to maintain the target implement angle.

A similar pattern is followed when lowering the boom 24 towards the ground from the top end 154 of its travel range. For example, as shown in FIG. 3, when initially lowering the boom 24 from the top end 154 of the travel range, the tilt cylinders 38 must be initially de-stroked (indicated by arrow 168) across the second range of boom angles 164 to pivot the implement 32 in the dumping direction 54 (FIG. 1) in order to maintain the implement 32 at the target implement angle. However, as the boom 24 is lowered past the tilt transition boom angle 158 and continues to be lowered towards the bottom end 152 of the travel range across the first range of boom angles 162, the control of the tilt cylinders 38 must be reversed to maintain the implement 32 at the target implement angle. Specifically, as shown in FIG. 3, as the boom transitions into the first range of boom angles 162 at the tilt transition boom angle 158 and is lowered through such angular range 162 towards the bottom end 152 of the travel range, the tilt cylinders 38 must be stroked (indicated by arrow 170) to pivot the implement 32 in the rollback direction 52 (FIG. 1) to maintain the target implement angle.

It should be appreciated that the dataset illustrated in FIG. 3 only provides an example tilt cylinder control curve for maintaining the implement 32 at one specific implement angle across the travel range of the boom 24. A unique curve will generally exist for each potential implement angle for a given machine (e.g., one curve for each implement angle along the implement's tilt range), with the tilt transition boom angle 158 (and, thus, the first and second boom angular ranges 162, 164) generally varying with variations in the target implement angle. Specifically, the vertex of the curve (i.e., the tilt transition boom angle) will generally shift left or right as the target implement angle is decreased or increased. Additionally, the various curves will also vary across machines having differing geometries and/or configurations for achieving tilting of the implement 32. However, despite such variations, the control strategy for the maintaining the applicable target implement angle will generally remain the same as the boom 24 lifted or lowered across the associated tilt transition boom angle (i.e., initially de-stroking the tilt cylinders 38 until the tilt transition angle is reached and then stroking the tilt cylinders 38 as the boom 24 is moves away from the tilt transition angle).

Thus, in accordance with aspects of the present subject matter, the tilt transition boom angle associated with maintaining a constant angular orientation of the implement 32 may be determined for each of a plurality of potential target implement angles for a given lift assembly configuration (e.g., via experimentation and/or modeling). Each tilt transition boom angle may then be stored in association with or correlated to its associated target implement angle for subsequent use. For instance, in one embodiment, a look-up table may be developed that correlates each tilt transition boom angle to the associated target implement angle for a given machine. In such an embodiment, when the operator provides an input selecting a target implement angle at which the implement 32 is to be maintained, the look-up table may be accessed or referenced to determine the tilt transition boom angle associated with the operator-selected target implement angle. The look-up table may, for example, be stored within the memory 106 of the computing system 102 (FIG. 2).

Figure 4:
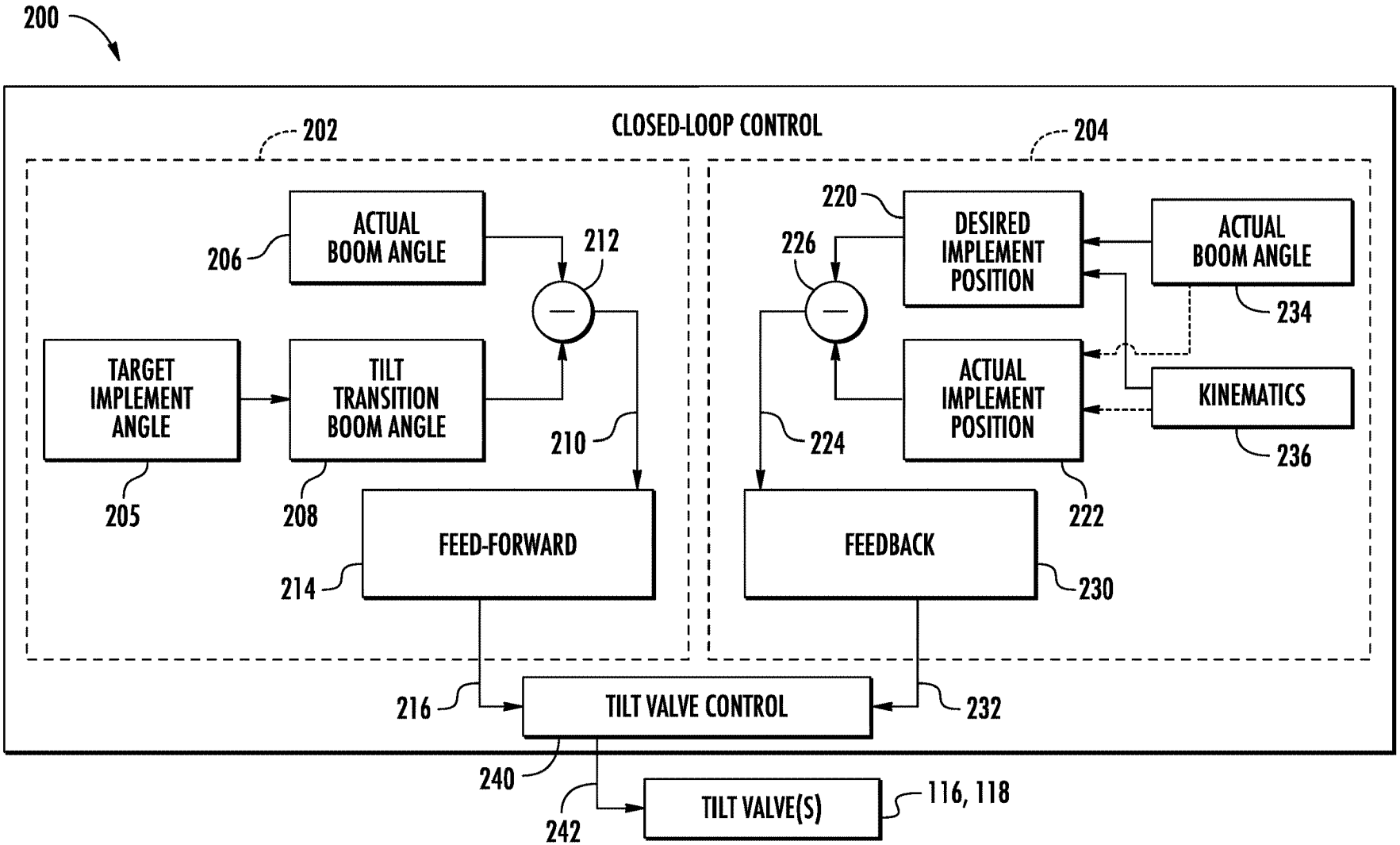
FIG. 4 illustrates a flow diagram of one embodiment of a closed-loop control algorithm that may be utilized by the control system shown in FIG. 2 in order to maintain an implement of a work vehicle at a constant angular orientation as the vehicle's boom is being moved in accordance with aspects of the present subject matter.

Referring now to FIG. 4, a flow diagram of one embodiment of a closed-loop control algorithm 200 that may be implemented by the computing system 102 (FIG. 2) for maintaining a constant angular orientation of an implement 32 is illustrated in accordance with aspects of the present subject matter. Specifically, in several embodiments, the disclosed control algorithm 200 may provide the work vehicle 10 with self-leveling functionality for the implement 32, thereby allowing the angular orientation of the implement 32 relative to the vehicle's driving surface (or relative to any other suitable reference point) to be maintained constant as the boom 24 is being moved along its travel range. For instance, the computing system 102 may be configured to initially learn a desired angular orientation for the implement 32 (e.g., referred to hereinafter as a target implement angle), such as by receiving an input from the operator (e.g., via a suitable input device 130) corresponding to the angle at which the implement 32 is to be maintained relative to the vehicle's driving surface 34. The computing system 102 may then implement the closed-loop control algorithm 200 to allow control signals to be generated for controlling the operation of the vehicle's tilt valve(s) 116, 118 in a manner that maintains the implement 32 at the target implement angle as the boom 24 is lifted or lowered relative to the driving surface.

In several embodiments, the closed-loop control algorithm 200 may employ both a feed-forward control portion (indicated by dashed box 202 in FIG. 4) and a feedback control portion (indicated by dashed box 204 in FIG. 4). The feed-forward control 202 may generally allow for the control algorithm 200 to reduce delays within the system, thereby increasing the system's responsiveness in relation to controlling the tilt valves 116, 118 and the corresponding tilt cylinders 38 of the vehicle's lift assembly 22, which, in turn, allows for more precise and accurate control of the implement's orientation/position. In addition, the feedback control 204 may allow for error-based adjustments to be made to the control signals generated by the computing system 102 that take into account variables not accounted for by the feed-forward control 202 (e.g., how loading and/or other variables may impact the responsiveness and/or effectiveness of the position control for the implement 32).

In several embodiments, the feed-forward control portion 202 of the disclosed algorithm 200 may be configured to receive one or more input signals associated with the position of the boom 24 relative to the specific tilt transition boom angle (see FIG. 3) associated with the operator-selected target implement angle (e.g., box 205). Specifically, in several embodiments, the feed-forward control portion 202 may be configured to determine a differential between the actual boom angle and the tilt transition boom angle, which may then be used to calculate an associated feed-forward output signal. For example, as shown in FIG. 3, the feed-forward control portion 202 may be configured to receive two input signals, namely an actual boom angle signal 206 and a tilt transition boom angle signal 208, and, based on such input signals 206, 208, generate a corresponding boom position differential signal 210 (e.g., via the difference block 212). The differential signal 210 (or the absolute value of such signal) may then be input into a feed-forward block 214 in order to generate a feed-forward output signal 216.

In general, the feed-forward output signal 216 may correspond to a speed control signal that, based on the input signals, is associated with a calculated rate of change or speed at which the implement 32 needs to be moved in order to maintain the implement 32 at the target implement angle relative to the vehicle's driving surface (or other reference point) as the boom 24 is being moved. Specifically, in several embodiments, the feed-forward block 214 may be configured to calculate the feed-forward output signal 216 as a function of the boom position differential (i.e., the difference between the actual boom angle and the tilt transition boom angle) and an applicable feed-forward gain(s) applied within the feed-forward control portion 202, such as by multiplying the boom angle differential by the applicable gain(s).

It should be appreciated that the actual boom angle signal 206 may, in several embodiments, generally derive from any suitable sensor(s) configured to monitor the position of the boom 23 relative to a known reference point. For instance, as indicated above, the computing system 102 may be communicatively coupled to one or more position sensors 132 for monitoring the boom's position. In such an embodiment, the actual boom angle signal 206 may be based directly (or indirectly) on the measurement signals provided by the position sensor(s) 132.

Additionally, in one embodiment, the actual boom angle signal 206 may represent or correspond to the current boom angle of the boom 24. Alternatively, the actual boom angle signal 206 may represent or correspond to an expected or future boom angle of the boom 24. For instance, in one embodiment, the computing system 102 may be configured to calculate an estimated or predicted angle at which it is believed that the boom 24 will be moved at some point in the future (e.g., at time ($\Delta t$)) based on, for example, the current implement speed and/or the average speed of the implement 32 over a given time period (e.g., over the previous 100 to 300 milliseconds). Such predicted boom angle (e.g., as the actual boom angle signal 206) may then be utilized with the tilt transition boom angle signal 208 to calculate the boom position differential signal 210.

It should also be appreciated that the tilt transition boom angle signal 208 may, in several embodiments, generally be determined based on the operator-selected target implement angle (e.g., box 205). For example, as indicated above, a look-up table may be stored within the memory 106 of the computing system 102 that correlates each potential target implement angle to a corresponding tilt transition boom signal. In such an embodiment, upon the operator providing an input associated with the selected target implement angle, the look-up table may be referenced or accessed to determine the applicable tilt transition boom angle.

Referring still to FIG. 4, as indicated above, the closed-loop control algorithm 200 may also include a feedback control portion 204 that allows for error-based adjustments to be made to the feed-forward output signal 216. Specifically, in several embodiments, the feedback control 204 may be configured to determine the error between the actual and desired implement position for the implement 32, which may then be used to adjust the calculated implement speed associated with the feed-forward output signal 216. Thus, as shown in FIG. 4, the feedback control portion 204 may be configured to receive two input signals, namely the desired implement position signal 220 and an actual implement position signal 222, and, based on such input signals 220, 222, generate a corresponding difference or error signal 224 (e.g., via the difference block 226). The error signal 224 may then be input into a feedback function block 230 to generate a feedback output signal 232 that may serve as an adjustment or correction factor for modifying the feed-forward output signal 216. For instance, the feedback output signal 232 may correspond to a speed correction factor that may be used to modify the implement speed associated with the feed-forward output signal 216.

It should be appreciated that the desired implement position signal 220 may generally correspond to the specific position at which the implement 32 must be located based on the current position of the boom 24 in order to maintain the implement 32 at the target implement angle. As indicated above with reference to FIG. 3, given the geometry and the mechanics of the lift assembly 22, the position of the implement 32 must be adjusted constantly via the tilt cylinders 38 as the position of the boom 24 is changed in order to maintain the desired angular orientation of the implement 32. Thus, as shown in FIG. 4, the desired implement position 220 may, in several embodiments, be determined based on an actual boom angle signal 234 (e.g., derived from the position sensor(s) 132 used to monitor the position of the boom 24) and/or a kinematics signal 236 associated with the geometry of the boom 24. In such embodiments, the boom angle associated with the input signal 234 may, for example, be used within a suitable algorithm or data table (e.g., a look-up table) that takes into account the boom geometry in order to determine the corresponding implement position required to maintain the implement 32 at the target implement angle. The resulting desired implement position 220 may then be compared to the actual implement position 222 (e.g., via the difference block 226) in order to generate the position error signal 224 and subsequently the resulting feedback output signal 232.

It should also be appreciated that the actual implement position signal 222 may, in several embodiments, generally derive from any suitable sensor(s) configured to monitor the position of the implement 32 relative to a known reference point. For instance, as indicated above, the computing system 102 may be communicatively coupled to one or more position sensors 132 for monitoring the implement's position. In such an embodiment, the actual implement position signal 222 may be based directly (or indirectly) on the measurement signals provided by the position sensor(s) 132. Alternatively, the actual implement position signal 222 may be calculated based on one or more input signals. For instance, as shown in dashed lines in FIG. 4, the actual implement position signal 222 may, in one embodiment, be modified based on inputs related to the boom position (e.g., signal 234) and/or the boom geometry (e.g., signal 236).

Referring still to FIG. 4, the output signals 216, 232 generated by the feed-forward and feedback control portions 202, 204 may then be input into a tilt valve control block 240 configured to generate a valve control command 242 for controlling the operation of the tilt valve(s) 116, 118. Specifically, in several embodiments, the calculated implement speed associated with the feed-forward output signal 216 may be adjusted based on the calculated speed correction factor associated with the feedback output signal 232 so as to produce a final adjusted speed for the implement 32. Thereafter, the adjusted speed value may be converted into a suitable valve control command 242 that may be transmitted to the tilt valve(s) 116, 118 in order to control the operation of the valve(s) 116, 118 in a manner that causes the implement 32 to be maintained at the target implement angle relative to the vehicle's driving surface (or relative to any other reference point) as the boom 24 is being moved along its range of travel.

It should be appreciated that the feed-forward and feedback output signals 216, 232 may be combined or otherwise processed in any suitable manner in order to generate the final valve control command(s) 242. For instance, in one embodiment, one of the signals may be used as a multiplier or modifier to adjust the other signal. In another embodiment, the feed-forward and feedback output signals 216, 232 may simply be summed to generate the final valve control command(s) 242.

Additionally, it should be appreciated that the feed-forward and feedback output signals 216, 232 may also be utilized to generate the final valve control command(s) 242 by predicting a future position for the boom 24 based on such signal(s), which may then be used to calculate the final valve control command(s) 242. In such instance, the future position for the boom 24 may generally correspond to an estimated or predicted position to which it is believed that the boom 24 will be moved at some point in the future (e.g., at time ($\Delta t$)) based on the adjusted implemented speed calculated using the feed-forward and feedback output signals 216, 232. Such predicted loader position may then be utilized to generate the appropriate valve command signal(s) 242.

Moreover, it should be appreciated that, when executing closed-loop control, one or both of the tilt valves 116, 118 may need to be switched back-and-forth between opened and closed states to maintain the implement 32 at the target implement angle as the boom 24 is being lifted or lowered, particularly due to overshoot conditions and/or when the boom is approaching the tilt transition boom angle along the associated tilt cylinder control curve (e.g., curve 150 shown in FIG. 3). To allow for the tilt valves 116, 118 to quickly respond to control commands (particularly when switching from a closed state to an opened state) and to minimize vibrations or jerky motions, the computing system 102 may, in several embodiments, be configured to execute a valve standby control methodology in which the control commands (e.g., current commands) to the tilt valves 116, 118 are regulated in a specified manner relative to the control command associated with each valve's cracking point (e.g., the current command at which the associated valve begins to open).

Figure 5:
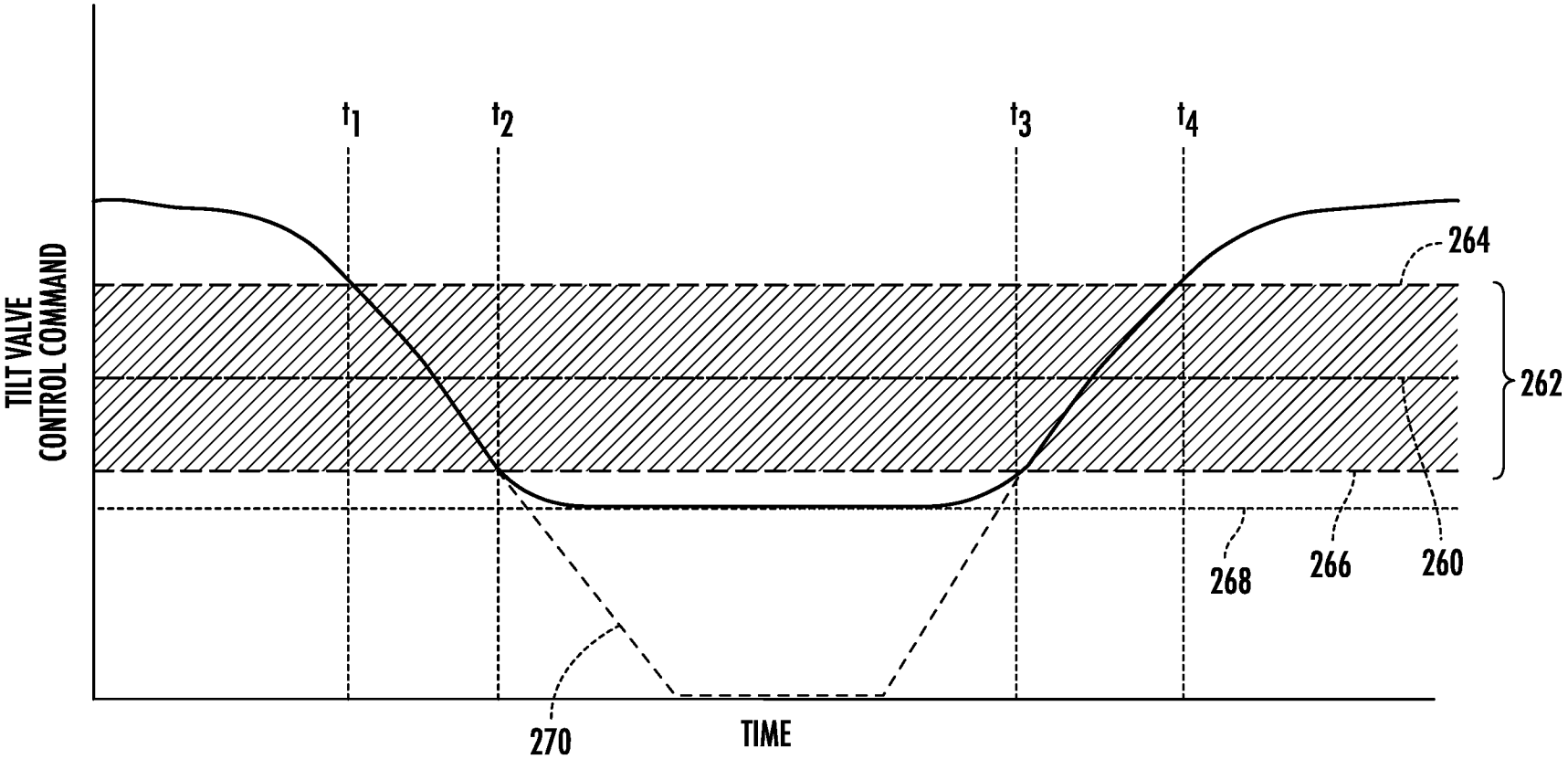
FIG. 5 illustrates a graphical view of an example implementation of a valve standby control methodology in which a valve control command is varied over time when transitioning a given valve from an opened state to a closed state and/or from the closed state to the opened state in accordance with aspects of the present subject matter.

For example, FIG. 5 illustrates a graphical view of an example implementation of a valve standby control methodology in which the valve control command is varied over time when transitioning one of the tilt valves 116, 118 from an opened state to a closed state (e.g., from $t_1$ to $t_2$) and then from the closed state back to the opened state (e.g., from $t_3$ to $t_4$). As shown in FIG. 5, the tilt valve 116, 118 may have an expected valve cracking point associated with a given valve cracking control command (indicated by line 260) such that the valve 116, 118 is expected to be in an opened state when a control command is applied that exceeds the valve cracking control command 260 and in a closed state when a control command is applied that is below valve cracking control command 260. However, due to manufacturing tolerances, valve wear, and/or other variables, the actual point at which valve transitions between the opened/closed states may vary. Thus, as shown in FIG. 5, a valve cracking buffer region 262 may be defined relative to the expected valve cracking control command 260 which specifies a range of valve control commands (e.g., between upper and lower threshold command values 264, 266) across which uncertainly exists as to whether the tilt valve is actually opened or closed.

By identifying the valve cracking buffer region 262 relative to the expected valve cracking control command 260, the tilt valves 116, 118 can be controlled in a manner that both minimizes jerkiness and improves overall responsiveness. Specifically, as shown in FIG. 5, the valve control command may be configured to be ramped down (e.g., from $t_1$ to $t_2$ when closing the valve) and ramped up (e.g., from $t_3$ to $t_4$ when opening the valve) at a controlled rate (e.g., at predetermined ramp-down and ramp-up rates), thereby preventing jerky motion as the valve is transitioned between opened and closed states. Moreover, as shown in the illustrated embodiment, when transitioning the valve to a closed state, the valve control command may be ramped down across the valve cracking buffer region 262 to a reduced control command (indicated by line 268) that is below the lower threshold control value 266 of the buffer region 262 by a predetermined amount, such as a control command 268 that differs from the control command associated with the lower threshold value 266 by less than 5% or less than 2% or less than 1%. The valve control command may then be maintained at this reduced control command 268 until it is necessary to re-open the tilt valve 116, 118. By maintaining the valve control command directly below the lower threshold 266 of the buffer region 262, the tilt valve may be quickly transitioned back to the opened state. In this regard, such a control methodology may provide improved system responsiveness, particularly over control systems that reduce the valve current command to zero or to some other minimal current command when closing the valve (e.g., a control curve that follows the dashed lines 270 in FIG. 3).

It should be appreciated that, in addition to the above-described standby control function (or as an alternative thereto), the computing system 102 may be configured to apply a valve lock-up control function that locks the operation of one or both tilt valves 116, 118 in certain instances, thereby reducing the frequent transitions between opened and closed states during dynamic control processing. For example, in one embodiment, the computing system 102 may be configured to lock-up the first tilt valve 116 (and, thus, prevent tilting of the implement 32 in the rollback direction) when the boom 24 is being lifted between the bottom end of its travel range and the tilt transition boom angle (e.g., lifting across the first range of boom angles 162 of FIG. 3) and when the boom 24 is being lowered between the top end of its travel range and the tilt transition boom angle (e.g., lowering across the second range of boom angles 164 of FIG. 3), as the implement 32 will only typically need to be tilted in the dump direction with such motion of the boom 24. Similarly, in one embodiment, the computing system 102 may be configured to lock-up the second tilt valve 118 (and, thus, prevent tilting of the implement 32 in the dump direction) when the boom 24 is being lowered between the tilt transition boom angle and the bottom end of its travel range (e.g., lowering across the first range of boom angles 162 of FIG. 3) and when the boom 24 is being raised between the tilt transition boom angle and the top end of its travel range (e.g., raising across the second range of boom angles 164 of FIG. 3), as the implement 32 will only typically need to be tilted in the rollback direction with such motion of the boom 24.

In addition, the computing system 102 may also be configured to apply a valve lock-up control methodology upon the occurrence of one or more other lock-up trigger events or conditions. For instance, in one embodiment, the computing system 102 may be configured to lock-up both tilt valves 116, 118 as the boom 24 is lifted or lowered across a small range of boom angles defined relative to the tilt transition boom angle (e.g., range 272 shown in FIG. 3), as very little boom movement is typically required across such angular range of boom angles. Additionally, in one embodiment, the computing system 102 may be configured to lock-up one or both tilt valves 116, 118 as the boom is moved into a small angular range(s) of boom angles defined at the bottom and/or top ends of the boom's travel range and/or at the hard mechanical stop limits for the boom 24. Moreover, in one embodiment, the computing system 102 may be configured to lock-up the second tilt valve 118 (and, thus, prevent tilting of the implement 32 in the dump direction) when the angular orientation of the implement 32 reaches a lower threshold angle to prevent material from inadvertently following from the material, thereby avoiding instances that could lead to safety hazards.

Figure 6:
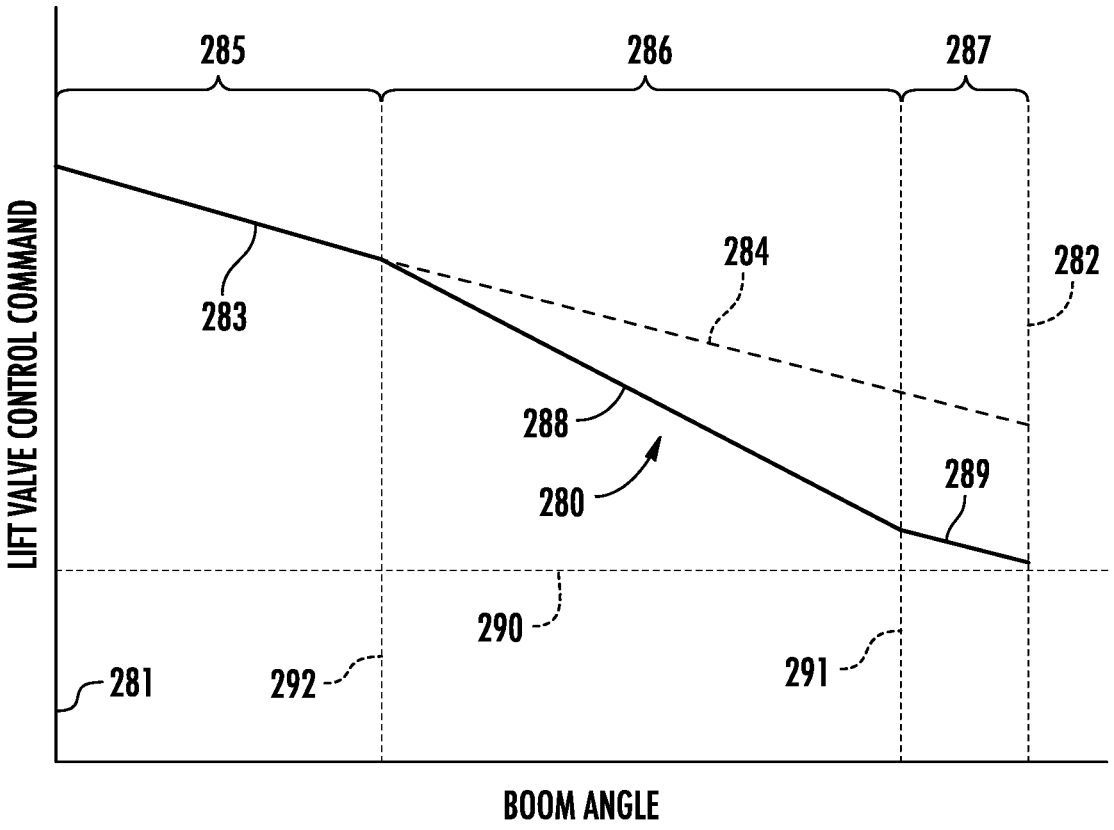
FIG. 6 illustrates an example boom control curve for controlling the movement of a boom of a work vehicle as it is raised from a bottom end of its travel range to a top end of its travel range in accordance with aspects of the present subject matter, particularly illustrating the lift valve control command being ramped-down at a variable rate to slow the movement of the boom as it nears the top end of its travel range.

Referring now to FIG. 6, an example boom control curve 280 for controlling the movement of a boom (e.g., boom 24 in FIG. 1) as it is raised from the bottom end of its travel range (indicated by line 281) to the top end of its travel range (indicated by line 282) is illustrated in accordance with aspects of the present subject matter. In conventional systems, the boom control command is typically ramped down at a single, constant rate as the boom 24 is raised towards the top end 282 of its travel range. For example, the input/output control mapping that correlates the boom lift inputs received from an associated operating input device (e.g., a boom control joystick) is often applied such that, with a constant boom lift input from the operator input device, the corresponding boom valve control command is reduced at a constant rate as the boom angle increases with movement of the boom 24 towards the top end 282 of the travel range (e.g., as indicated by solid line 283 and dashed line 284 in FIG. 6). However, even with such a ramped-down rate, a significant boom acceleration typically occurs as the boom approaches the top end 282 of its travel range due to the mechanical design/geometry of the lift assembly 22, which results in a hard impact against the mechanical boom stops as the boom 24 reaches the top end 282 of the range. To address this issue, an adjusted input/output control mapping can be applied that varies the ramp rate of the boom valve control command across a given range of boom angles to reduce the speed/acceleration of the boom 24 as it nears the top end 282 of the travel range and, thus, prevent hard impacts against the mechanical stops.

For example, in several embodiments, the input/output control mapping may be adjusted such that a variable ramp-down rate is applied as the boom 24 is raised towards the top end 282 of its travel range. Specifically, as shown in FIG. 6, the input/output control mapping includes three separate ramp-down zones, namely a first ramp-down zone extending across a first range of boom angles 285, a second ramp-down zone extending across a second range of boom angles 286, and a third ramp-down zone extending across a third range of boom angles 287. In the first ramp-down zone, the input/output control mapping applies a first ratio between the input command provided by the operator (e.g., via the boom control joystick) and boom valve control command such that the control command ramps down at a first ramp-down rate as the boom 24 is raised across the first range of boom angles 285 (e.g., as indicated by solid line 283). However, as the boom transitions into the second ramp-down zone, the input/output control mapping applies a reduced, second ratio between the input command provided by the operator and boom valve control command such that the control command ramps down at a higher, second ramp-down rate as the boom 24 is raised across the second range of boom angles 286 (e.g., as indicated by solid line 288). Finally, as the boom 24 transitions into the third ramp-down zone, the input/output control mapping again applies the first ratio between input command provided by the operator and boom valve control command such that the control command ramps down at the first ramp-down rate as the boom 24 is raised across the third range of boom angles 287 to the top end 282 of the travel range (e.g., as indicated by solid line 289). Such variable ramping allows the boom to be lifted in a more controlled manner is it nears the top end of its travel range.

It should be appreciated that, although the illustrated embodiment applies the same ramp-down rate across the first and third ramp-down zones, the ramp-down rate may, in other embodiments, differ between the first and third ramp-down zones. Additionally, although the illustrated embodiment ramps down the control command linearly, a non-linear relationship may be defined between the boom valve control command the boom angle as the boom 24 is raised between the top and bottom ends 282, 281 of its travel range.

As shown in FIG. 6, in one embodiment, the applied ramp-down rates and associated angular ranges 285, 286, 287 may be selected such that, as the boom 24 reaches the top end 282 of its travel range, the boom valve control command is equal to a final control command that is just above the control command associated with cracking point for the lift valve (indicated by line 290), such as a final control command that exceeds valve cracking control command 290 by less than 10% or less than 5% or less than 2% or less than 1%. For instance, the specific boom angle at which control methodology transitions between the second ramp-down zone and the third-ramp down zone (e.g., as indicated by line 291) may be determined by selecting the boom angle from which the control command can be ramped down at the applicable ramp rate for the third ramp-down zone (e.g., the first ramp rate) such that the valve control command to be applied as the boom 24 reaches the top end 282 of its travel rage is equal to the desired final control command. Additionally, in one embodiment, the specific boom angle at which control methodology transitions between the first ramp-down zone and the second ramp-down zone (e.g., as indicated by line 292) may be selected based on the kinematics or geometry of the machine's lift assembly such that the increased ramp rate is applied at or around the point at which the boom 24 would otherwise begin to accelerate assuming a constant ramp-down rate was applied (e.g., assuming dashed line 284 was followed as opposed to solid line 288).

Figure 7:
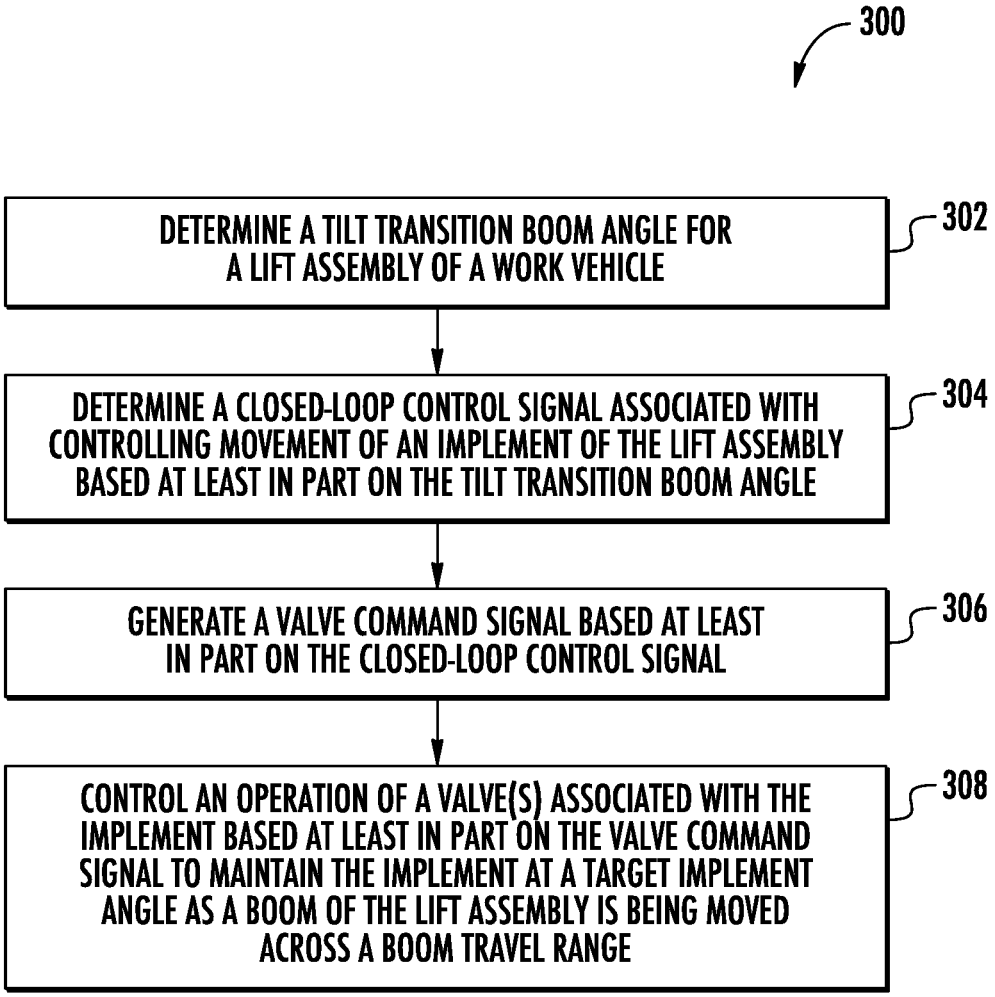
FIG. 7 illustrates a flow diagram of one embodiment of a method for automatically adjusting the position of an implement of a lift assembly of a work vehicle in accordance with aspects of the present subject matter.

Referring now to FIG. 7, a flow diagram of one embodiment of a method 300 for automatically adjusting the position of an implement of a lift assembly of a work vehicle is illustrated in accordance with aspects of the present subject matter. In general, the method 300 will be described herein with reference to the work vehicle 10, the system 100, and the various control algorithms/functions described above with reference to FIGS. 1-6. However, it should be appreciated by those of ordinary skill in the art that the disclosed method 300 may generally be implemented with any work vehicle having any suitable vehicle configuration and/or within any system having any suitable system configuration, as well as in association with any other suitable control algorithms/functions. In addition, although FIG. 7 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 7, at (302), the method 300 includes determining a tilt transition boom angle for a lift assembly of a work vehicle. As indicated above, the tilt transition boom angle may generally correspond to a position within the travel range of the boom 24 at which a direction of movement of the implement 32 must be reversed in order to maintain the implement 32 at a target implement angle as the boom 24 is being moved across such position. For instance, with reference to the tilt cylinders 38, the tilt transition boom angle may generally correspond to the position within the boom travel range at which the tilt cylinder(s) 38 must transition between being stroked and de-stroked in order to maintain the implement at the target implement angle. In one embodiment, the tilt transition boom angle for each potential implement angle of the lift assembly 22 may be predetermined and stored within the memory 106 of the computing system 102. In such an embodiment, upon selection of the target implement angle for the implement 32, the computing system 102 may be configured to determine the tilt transition boom angle associated with the selected target implement angle.

Additionally, at (304), the method 300 incudes determining a closed-loop control signal associated with controlling movement of an implement of the lift assembly based at least in part on the tilt transition boom angle. Specifically, as indicated above, the computing system 102 may be configured to determine a feed-forward output control signal based at least in part on the tilt transition boom angle. For instance, in one embodiment, the computing system may be configured to determine a boom position differential between the tilt transition boom angle and an actual boom angle of the boom (e.g., a current boom angle or a predicted future boom angle of the boom), with the boom position differential being used to generate the feed-forward output control (e.g., by multiplying the boom position differential by an applicable control gain(s)).

Moreover, at (306), the method 300 includes generating a valve command signal based at least in part on the closed-loop control signal. For example, as indicated above, the computing system 102 may be configured to execute a closed-loop control algorithm 200 that utilizes a combination of feed-forward and feedback control to generate a tilt valve command for controlling the operation of the tilt valves 116, 118.

Referring still to FIG. 7, at (308), the method 300 includes controlling an operation of at least one valve associated with the implement based at least in part on the valve command signal to maintain the implement at a target implement angle as a boom of the lift assembly is being moved across its boom travel range. Specifically, as indicated above, the valve command generated via the closed-loop control algorithm 200 may be used to control the operation of the tilt valves 116, 118 in a manner that causes the implement 32 to be maintained at the target implement angle relative to the vehicle's driving surface (or relative to any other reference point) as the boom 24 is being moved along its range of travel.

It is to be understood that the steps of the control algorithm 200 and/or method 300 are performed by the computing system 102 upon loading and executing software code or instructions which are tangibly stored on a tangible computer readable medium, such as on a magnetic medium, e.g., a computer hard drive, an optical medium, e.g., an optical disc, solid-state memory, e.g., flash memory, or other storage media known in the art. Thus, any of the functionality performed by the computing system 102 described herein, such as the control algorithm 200 and/or method 300, is implemented in software code or instructions which are tangibly stored on a tangible computer readable medium. The computing system 102 loads the software code or instructions via a direct interface with the computer readable medium or via a wired and/or wireless network. Upon loading and executing such software code or instructions by the computing system 102, the computing system 102 may perform any of the functionality of the computing system 102 described herein, including any steps of the control algorithm 200 and/or method 300 described herein.

The term "software code" or "code" used herein refers to any instructions or set of instructions that influence the operation of a computer or controller. They may exist in a computer-executable form, such as machine code, which is the set of instructions and data directly executed by a computer's central processing unit or by a controller, a human-understandable form, such as source code, which may be compiled in order to be executed by a computer's central processing unit or by a controller, or an intermediate form, such as object code, which is produced by a compiler. As used herein, the term "software code" or "code" also includes any human-understandable computer instructions or set of instructions, e.g., a script, that may be executed on the fly with the aid of an interpreter executed by a computer's central processing unit or by a controller.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

The invention claimed is:

1. A method for automatically adjusting the position of an implement of a lift assembly of a work vehicle, the lift assembly comprising a boom coupled to the implement, the method comprising:

determining, with the computing system, a tilt transition boom angle for the lift assembly that corresponds to a position within a boom travel range of the boom at which a direction of movement of the implement must be reversed to maintain the implement at a target implement angle as the boom is being moved across such position;

determining, with the computing system, a closed-loop control signal associated with controlling movement of the implement based at least in part on the tilt transition boom angle;

generating, with the computing system, a valve command signal based at least in part on the closed-loop control signal; and controlling, with computing system, an operation of at least one valve associated with the implement based at least in part on the valve command signal to maintain the implement at the target implement angle as the boom is being moved across the boom travel range.

2. The method of claim 1, further comprising receiving, with the computing system, an input indicative of the target implement angle at which the implement is to be maintained as the boom is being moved across the boom travel range.

3. The method of claim 1, wherein determining the tilt transition boom angle for the lift assembly comprises determining the tilt transition boom angle based at least in part on the target implement angle.

4. The method of claim 1, further comprising determining, with the computing system, a boom position differential between the tilt transition boom angle and an actual boom angle of the boom; and wherein determining the closed-loop control signal comprises determining the closed-loop control signal as a function of the boom position differential.

5. The method of claim 4, wherein the actual boom angle comprises a current boom angle of the boom or a predicted future boom angle of the boom.

6. The method of claim 1, wherein the at least one valve comprises a tilt valve configured to regulate a supply of hydraulic fluid to a tilt cylinder coupled to the implement and wherein the tilt transition boom angle corresponds to the position within the boom travel range of the boom at which the tilt cylinder must transition between being stroked and de-stroked in order to maintain the implement at the target implement angle as the boom is being moved across such position.

7. The method of claim 1, wherein the at least one valve is configured to be actuated between an opened state and a closed state and wherein a valve cracking control command is associated with a valve cracking point at which the at least one valve transitions between the opened and closed states, the method further comprising:

identifying, with the computing system, a valve cracking buffer region relative to the valve cracking control command that extends across a range of control commands from a maximum command threshold to a minimum command threshold;

when transitioning the at least one valve from the opened state to the closed state, reducing the valve control command across the valve cracking buffer region to a reduced control command that is less than the minimum command threshold, the reduced control command differing form the minimum command threshold by less than 5%; and maintaining the valve control command at the reduced control command until the at least one valve is to be transitioned back to the opened state.

8. The method of claim 7, wherein reducing the valve control command across the valve cracking buffer region comprises reducing the valve control command across the valve cracking buffer region to the reduced control command at a predetermined ramp rate.

9. The method of claim 1, wherein the at least one valve comprises at least one tilt valve configured to regulate a supply of hydraulic fluid to a tilt cylinder coupled to the implement, the tilt cylinder configured to pivot the implement in both a first direction and a second direction opposite the first direction; and wherein the method further comprises applying, with the computing system, a valve lock-up control function in association with the at least one tilt valve such that the tilt cylinder is prevented from pivoting the implement in one of the first direction or the second direction as the boom is being moved towards the tilt transition boom angle.

10. The method of claim 1, wherein the at least one valve comprises at least one tilt valve configured to regulate a supply of hydraulic fluid to a tilt cylinder coupled to the implement, the tilt cylinder configured to pivot the implement relative to the boom in both a first direction and a second direction opposite the first direction; and wherein the method further comprises applying, with the computing system, a valve lock-up control function in association with the at least one tilt valve such that the tilt cylinder is prevented from pivoting the implement in both the first direction and the second direction as the boom is being moved across a predetermined range of boom angle defined relative to the tilt transition boom angle.

11. The method of claim 1, wherein the at least one valve comprises at least one tilt valve and wherein the work vehicle further comprises at least one lift valve configured to regulate a supply of hydraulic fluid to a lift cylinder coupled to the boom, the lift cylinder configured to raise and lower the boom across the boom travel range;

wherein the method further comprises:

receiving, with the computing device, an input associated with controlling an operation of the lift cylinder to raise the boom towards a top end of the boom travel range; and applying, with the computing system, an input/output control mapping in association with the input that specifies that a lift valve control command for controlling the operation of the lift valve is ramped down at a variable rate as the boom is raised towards the top end of the boom travel range.

12. The method of claim 11, wherein:

applying the input/output control mapping comprises applying the input/output control mapping such that the lift valve control command is: (1) ramped down at a first ramp-down rate across a first range of boom angles; and (2) ramped down at a second ramp-down rate across a second range of boom angles;

the second range of boom angles is closer to the top end of the boom travel range than the first range of boom angles; and the second ramp-down rate is greater than the first ramp-down rate.

13. The method of claim 12, wherein:

applying the input/output control mapping comprises further applying the input/output control mapping such that the lift valve control command is ramped down at the first ramp-down rate across a third range of boom angles; and the second range of boom angles is defined across the boom travel range between the first and third ranges of boom angles.

14. The method of claim 1, wherein the closed-loop control signal comprises a feed-forward control signal and further comprising determining, with the computing system, a feedback control signal for the implement based at least in part on a positional error determined for the implement; and wherein generating the valve command signal comprises generating the valve command signal based at least in part on the feed-forward control signal and the feedback control signal.

15. A system for controlling the operation of a work vehicle, the system comprising:

a lift assembly including a boom and an implement coupled to the boom;

at least one tilt valve in fluid communication with a corresponding tilt cylinder, the at least one tilt valve being configured to control a supply of hydraulic fluid to the tilt cylinder to adjust a position of the implement relative to the boom;

a computing system communicatively coupled to the at least one tilt valve, the computing system being configured to:

receive an input indicative of a target implement angle at which the implement is to be maintained as the boom is being moved across a boom travel range of the boom;

determine a tilt transition boom angle for the lift assembly based at least in part on the target implement angle, the tilt transition boom angle corresponding to a position within the boom travel range at which the tilt cylinder must transition between being stroked and de-stroked in order to maintain the implement at the target implement angle as the boom is being moved across such position;

determine a closed-loop control signal associated with controlling movement of the implement based at least in part on the tilt transition boom angle;

generate a valve command signal based at least in part on the closed-loop control signal; and control an operation of the at least one tilt valve based at least in part on the valve command signal to maintain the implement at the target implement angle as the boom is being moved across the boom travel range.

16. The system of claim 15, wherein the computing system is further configured to determine a boom position differential between the tilt transition boom angle and an actual boom angle of the boom, the closed-loop control signal being determined as a function of the boom position differential.

17. The system of claim 15, wherein:

the at least one tilt valve is configured to be actuated between an opened state and a closed state and a valve cracking control command is associated with a valve cracking point at which the at least one tilt valve transitions between the opened and closed states;

the computing system is further configured to:

identify a valve cracking buffer region relative to the valve cracking control command that extends across a range of control commands from a maximum command threshold to a minimum command threshold;

when transitioning the at least one tilt valve from the opened state to the closed state, reducing the valve control command across the valve cracking buffer region to a reduced control command that is less than the minimum command threshold, the reduced control command differing form the minimum command threshold by less than 5%; and maintain the valve control command at the reduced control command until the at least one tilt valve is to be transitioned back to the opened state.

18. The system of claim 15, wherein:

the tilt cylinder is configured to pivot the implement relative to the boom in both a first direction and a second direction opposite the first direction; and the computing system is further configured to at least one of:

apply a first valve lock-up control function in association with the at least one tilt valve such that the tilt cylinder is prevented from pivoting the implement in one of the first direction or the second direction as the boom is being moved towards the tilt transition boom angle; or apply a second valve lock-up control function in association with the at least one tilt valve such that the tilt cylinder is prevented from pivoting the implement in both the first direction and the second direction as the boom is being moved across a predetermined range of boom angle defined relative to the tilt transition boom angle.

19. The system of claim 15, wherein:

the system further comprises at least one lift valve in fluid communication with a corresponding lift cylinder configured to raise and lower the boom across the boom travel range;

the computing system is further configured to:

receive an input associated with controlling an operation of the lift cylinder to raise the boom towards a top end of the boom travel range;

apply an input/output control mapping in association with the input that specifies that a lift valve control command for controlling the operation of the lift valve is ramped down as the boom is raised towards the top end of the boom travel range, the input/output control mapping being applied such that the lift valve control command is: (1) ramped down at a first ramp-down rate across a first range of boom angles; and (2) ramped down at a second ramp-down rate across a second range of boom angles;

the second range of boom angles is closer to the top end of the boom travel range than the first range of boom angles; and the second ramp-down rate is greater than the first ramp-down rate.

20. The system of claim 19, wherein:

the computing system is configured to apply the input/output control mapping such that the lift valve control command is further ramped down at the first ramp-down rate across a third range of boom angles; and the second range of boom angles is defined across the boom travel range between the first and third ranges of boom angles.

* * * * *